US006755699B2

(12) United States Patent
Beers et al.

(10) Patent No.: US 6,755,699 B2
(45) Date of Patent: Jun. 29, 2004

(54) REDUCED INSERTION FORCE CONTACT PIN TIP

(75) Inventors: Robert Duane Beers, Titusville, PA (US); Aaron Michael Krott, Temperance, MI (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/244,911

(22) Filed: Sep. 16, 2002

(65) Prior Publication Data

US 2004/0053543 A1 Mar. 18, 2004

(51) Int. Cl.[7] ..... H01R 13/02
(52) U.S. Cl. ..... 439/884
(58) Field of Search ..... 439/324, 346, 439/374, 884, 887, 889

(56) References Cited

U.S. PATENT DOCUMENTS

| | | | | |
|---|---|---|---|---|
| 3,829,820 A | | 8/1974 | Hubner et al. | 339/88 C |
| 4,010,993 A | * | 3/1977 | Hohenberger et al. | 439/176 |
| 4,740,180 A | * | 4/1988 | Harwath et al. | 439/856 |
| 5,137,462 A | * | 8/1992 | Casey et al. | 439/74 |
| 5,989,053 A | * | 11/1999 | Wheeler | 439/387 |

* cited by examiner

*Primary Examiner*—Dean A. Reichard
*Assistant Examiner*—Adolfo Nino

(57) ABSTRACT

An electrical pin contact is provided that includes an initial contact portion joined to a main body. The initial contact portion has a lead end configured to be inserted into a female contact and an external surface with a tapered contour extending between the lead end and the main body. The external surface includes at least one recessed cavity formed therein to define a void in the tapered contour for receiving material accumulated during a mating operation.

17 Claims, 2 Drawing Sheets

REDUCED INSERTION FORCE CONTACT PIN TIP

BACKGROUND OF THE INVENTION

Certain embodiments of the present invention generally relate to a contact configured to reduce the insertion force experienced during a mating operation.

Numerous contacts have been proposed with different shapes and sizes to establish electrical communication between mating halves of a connector assembly. Often these contacts are arranged in arrays of multiple contacts. With advances in technology, contacts are declining in size, in order that the average number of terminal positions per electrical connector may increase. As the number of contacts increases, the insertion force required to mate the connectors similarly increases.

One common shape for the male contact is a pin that is accepted between beams of a female contact. The male and female contacts are generally plated to provide desired electrical performance characteristics. However, when the contacts are mated, the male and female contacts can scrape against each other, causing removal and buildup of plating material. The buildup of plating material interferes with the male contact as it is advanced into the female contact which increases the required insertion force. Harder plating materials may be used to reduce removal and buildup, and consequently reduce insertion forces, but the use of such harder plating materials may result in reduced electrical performance or added cost to manufacture the connector assembly.

Often, male contacts are shaped with a leading edge configured to facilitate insertion into the female contact. For instance, the leading edge may be tapered at a transition area near the permanent contacting portion of the male contact. The insertion force of a contact system increases and peaks as the female contact surfaces ride over the transition area. As the male and female contacts join, the plating material collects. In particular, the plating builds up in the transition area due to scraping.

A need exists for an improved contact to overcome the above-noted and other disadvantages of conventional contacts.

BRIEF SUMMARY OF THE INVENTION

At least one embodiment is provided that includes an electrical pin contact comprising an initial contact portion joined to a main body. The initial contact portion has a lead end configured to be inserted into a female contact and an external surface with a tapered contour extending between the lead end and the main body. The external surface includes at least one recessed cavity formed therein to define a void in the tapered contour for receiving material accumulated during a mating operation.

The recessed cavity may intersect the tapered contour at opposed lateral edges. The lateral edges converge proximate the lead end and proximate the main body. Further, the pin contact may comprise a transition area joining the initial contact portion and the main body. The main body includes a mating contact portion having a cross section with a first area, and the initial contact portion includes a front edge having a cross section with a second area. The second area is smaller than the first area.

Optionally, the initial contact portion may include a tapered rectangular cross section having first and second recessed cavities in top and bottom surfaces of said initial contact portion.

At least one embodiment provides an electrical contact system comprising a contact pin and a female contact matable with the contact pin. The contact pin includes a tapered contact portion joined to a main body. The tapered contact portion includes an evenly contoured external surface and an indentation recessed into the external surface. The female contact includes at least one contact portion configured to contact the main body of the contact pin when the contact pin and the female contact are in a fully mated position. The female contact frictionally slides over the external surface of the contact pin proximate the indentation.

The female contact may slidably engage the contact pin on opposite sides of the indentation when the contact pin is inserted into the female contact. Optionally, the female contact may include a resiliently deflectable beam configured to contact the contact pin. The resiliently deflectable beam contacts the tapered contact portion and slides over the indentation as the contact pin is inserted into the female contact. Additionally or alternatively, the tapered contact portion may include a front edge and generally conic sloped surface leading from the front edge to the main body.

At least one embodiment provides a contact pin and a female contact matable with the contact pin. The contact pin includes an initial contact portion joined to a main body. The initial contact portion includes an external surface and an indentation recessed into the external surface. The main body includes a mating contact portion. The contact pin includes a transition area joining the initial contact portion and the mating contact portion. The mating contact portion has a substantially rectangular cross section. The initial contact portion includes a front edge having a cross section that is smaller than the rectangular cross section of the mating contact portion. Also, the initial contact portion includes a sloped surface leading from the front edge to the transition area. The female contact includes at least one contact portion configured to contact the main body of the contact pin when the contact pin and the female contact are in a fully mated position. The female contact frictionally slides over the external surface of the contact pin proximate the indentation. The female contact also includes a resiliently deflectable beam configured to contact the contact pin. The resiliently deflectable beam contacts the initial contact portion and slides over the indentation as the contact pin is inserted into the female contact.

The electrical contact system may include a pair of opposed resilient beams receiving the male contact pin. Further, the indentation may extend substantially from a lead end of the tapered contact portion to the transition area.

Certain embodiments of the present invention thus provide an electrical contact that reduces the required mating insertion force.

Figure 1:
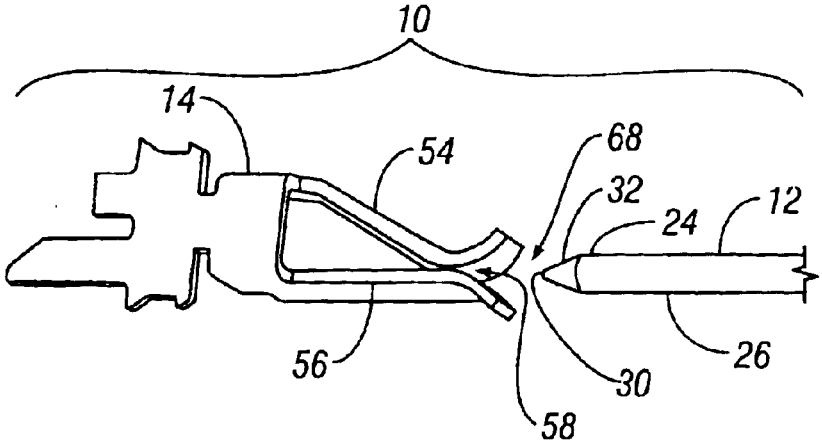
FIG. 1 illustrates a perspective view of a contact system, when in an unmated position, formed in accordance with an embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates an electrical contact system 10 including a male pin contact 12 and a female contact 14. The female contact 14 accepts the pin contact 12 to establish electrical communication therebetween. The pin contact 12 may be part of an array (not shown) of similar pin contacts 12 held by a first connector (not shown). The female contact 14 may be part of a corresponding array (not shown) of similar female contacts 14 held by a second connector (not shown). Due to the mating of the pin contacts 12 and female contacts 14, the first and second connectors provide electrical communication therebetween when joined.

Figure 2:
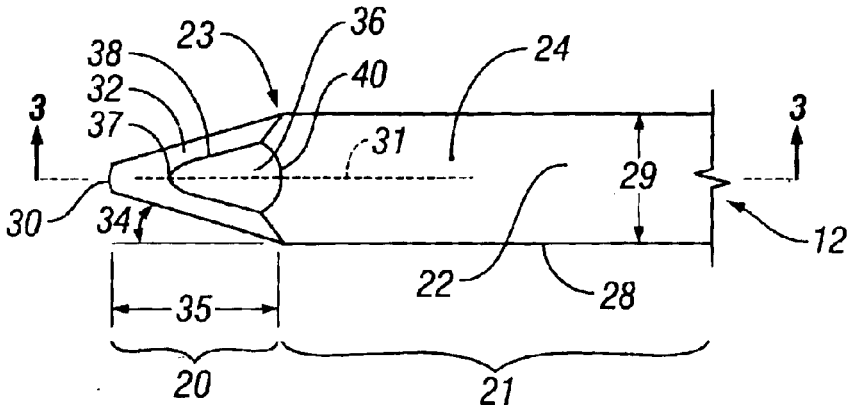
FIG. 2 illustrates a top plan view of an end portion of a male pin formed in accordance with an embodiment of the present invention.
Figure 3:
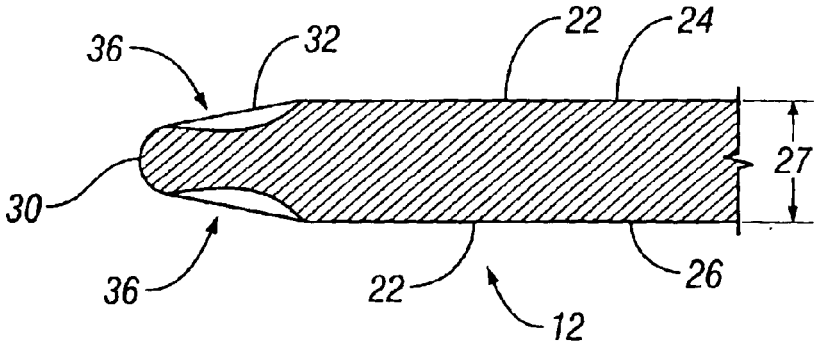
FIG. 3 illustrates a sectional view of the male pin taken along line 3—3 of FIG. 2.

FIG. 2 illustrates a top plan view of the pin contact 12, and FIG. 3 illustrates a sectional elevation view of the pin contact 12 taken along line 3—3 of FIG. 2. The pin contact 12 may have a circular, oval, square, or rectangular cross-section, or any other desired shape. The pin contact 12 includes an initial contact portion 20 joined to a main body 21 at a transition area 23. The pin contact 12 also includes a top 24 and a bottom 26 joined by sides 28. In the illustrated embodiment, the top 24 and bottom 26 are substantially identical and may be treated as interchangeable. The top 24 and bottom 26 are separated by a height 27 (FIG. 3), and the sides 28 are separated by a width 29 (FIG. 2). While FIGS. 2–3 illustrate a substantially even height 27 and width 29, one, or both dimensions may vary along a tapered cross-section. The main body 21 includes mating contact portions 22 on the top 24 and bottom 26 of the pin contact 12. Me mating contact portions 22 are configured to be in electrical communication with the female contact 14 when the pin contact 12 is in a final mating position with the female contact 14. Rearward of the mating contact portion 22, the main body 21 of the pin contact 12 is mounted to an electrical connector (not shown).

The front of the pin contact 12 terminates at a front edge 30. The front edge 30 has a smaller cross-sectional area than that of the pin contact 12 at the mating contact portion 22, thereby providing easier initial entry into the female contact 14. A sloped surface 32 joins the front edge 30 to the main body 21 at the transition area 23. The sloped surface 32 may be a generally conical shape sloping from the front edge 30 at an acute angle 34 for a distance 35. The angle 34 and distance 35 may vary depending upon several factors such as the length of the travel during mating and the insertion forces.

The pin contact 12 includes one or more dimples 36 in the sloped surface 32. The dimple 36 recedes beneath the sloped surface 32 and provides a depressed or indented cavity in which scraped material (e.g., plating, corrosion, or other) may accumulate instead of building up elsewhere. The dimple 36 begins at a leading point 37 near the front edge 30 and extends back toward the main body 21 of the male pin 21. The leading point 37 is located longitudinally along a center line 31 of the pin contact 12 and at intermediate point between the front edge 30 and the transition area 23. The boundary of the dimple 36 expands laterally outward from the center line 31 of the male pin and rearward toward the main body 21 along two lateral edges 38. Proximal to the transition area 23 where the initial contact portion 20 is joined to the main body 21, the lateral edges 38 are joined by a back edge 40 that marks the rearward boundary of the dimple 36 extending past the transition area 23. By way of example, the dimple 36 may be coined into the pin contact 12 after the sloped surface 32 has been formed. In FIG. 2, the dimple 36 is substantially cone shaped. However, the shape of the dimple 36 may vary. For example, the dimple 36 may be oval, circular, rectangular, triangular, and the like. In the illustrated embodiment, there are opposed dimples 36 in the initial contact portion 20 located proximal to both the top 24 and bottom 26 of the pin contact 12. Optionally, only one dimple 36 may be provided, or alternatively, 3 or more dimples 36.

Figure 4:
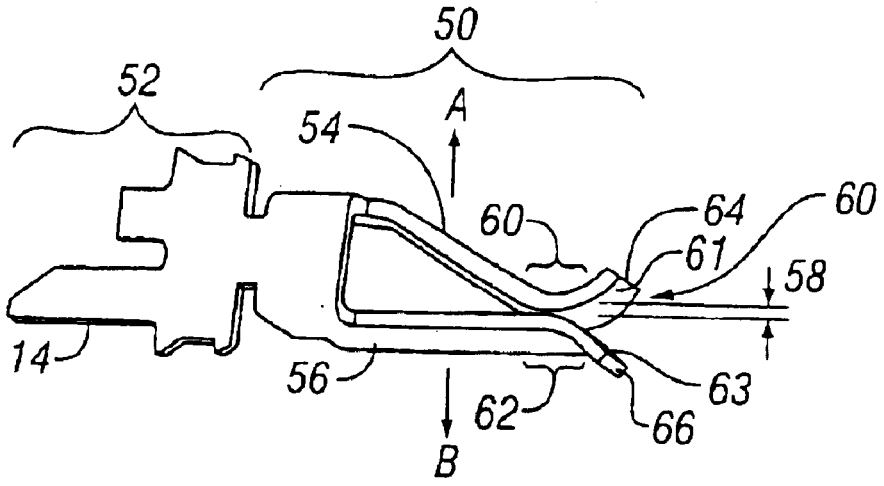
FIG. 4 illustrates a side perspective view of a female contact formed in accordance with an embodiment of the present invention.

FIG. 4 illustrates a perspective view of the female contact 14. The female contact 14 includes a front portion 50 and a rear portion 52. The rear portion 52 is mounted to an electrical connector (not shown) and the front portion 50 accepts and engages the pin contact 12 when fully mated therewith.

The front portion 50 includes an upper beam 54 and a lower beam 56 extending generally away from the rear portion 52 and shaped to converge on one another. The upper beam 54 and lower beam 56 are resiliently flexible. A gap 58 may separate the upper beam 54 and the lower beam 56 at the point where they are nearest each other. An upper contact portion 60 and lower contact portion 62 are located on the upper beam 54 and lower beam 56, respectively, proximal to the point at which the upper beam 54 and lower beam 56 are nearest each other. The upper contact portion 60 includes an upper central area 61 proximal to its longitudinal center. The lower contact portion 62 includes a lower central area 63 proximal to its longitudinal center. The gap 58 is dimensioned to be smaller than the height 27 of the pin contact 12 at the transition area 23. Thus, when the pin contact 12 enters the gap 58, the upper beam 54 is biased upward in direction A and/or the lower beam 56 is biased downward in direction B. The resiliency of the upper beam 54 and the lower beam 56 ensures consistent contact between the pin contact 12 and female contact 14.

As the upper beam 54 and lower beam 56 extend away from the rear portion 52 past the upper contact portion 60 and the lower contact portion 62, the upper beam 54 and lower beam 56 are shaped to extend away from each other, terminating at upper and lower leading edges 64 and 66, respectively, forming a mouth 68. The distance between the upper beam 54 and lower beam 56 at the mouth 68 is greater than that at the gap 58 and also greater than the height 27 of the pin contact 12 at the transition area 23. Thus, the mouth 68 cooperates with the front edge 30 of the pin contact 12 to facilitate alignment when the pin contact 12 and female contact 14 are first brought into contact One or both of the pin contact 12 and female contact 14 may be plated. The plating may be, for example, gold plating or solder. One or both of the pin contact 12 and female contact 14 may also have a zinc underplating. Further, the pin contact 12 and female contact 14 may each have substantially similar platings, so that similar compositions contact each other when the pin contact 12 and female contact 14 are mated.

Figure 5:
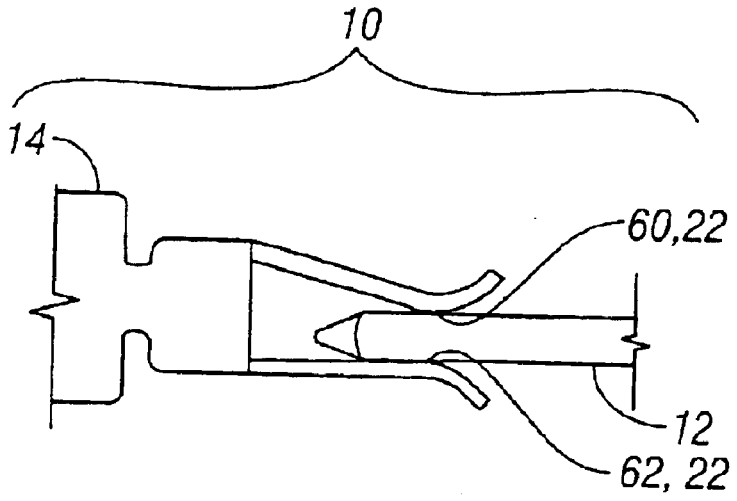
FIG. 5 illustrates a perspective view of a contact system, when in a fully mated position, formed in accordance with an embodiment of the present invention.

With particular reference to FIGS. 1 and 5, the mating process for the pin contact 12 and female contact 14 will now be described. FIG. 1 illustrates the pin contact 12 and the female contact 14 while in an unmated position, and FIG. 5 illustrates the pin contact 12 and female contact 14 while in a fully mated position.

Prior to mating, the pin contact 12 and female contact 14 are aligned so that the front edge 30 of the pin contact 12 faces toward the mouth 68 of the female contact 14. Also, the pin contact 12 is oriented such that the top 24 will contact the upper beam 54 of the female contact 14, and the bottom 26 will contact the lower beam 56. In practice, the pin contact 12 and female contact 14 may be symmetric, so the proper orientation may only require that the dimples 36 (see FIGS. 2–3) of the pin contact 12 be aligned with upper and lower contact portions 60, 62 (see also FIG. 4) of the female contact 14. With the pin contact 12 and female contact 14 aligned as described above, the pin contact 12 and female contact 14 are brought together.

As the pin contact 12 and female contact 14 are brought together, the front edge 30 of the pin contact 12 enters the mouth 68 of the female contact 14. As the pin contact 12 and female contact 14 are further urged together, the mouth 68 guides the front edge 30 of the pin contact 12 into the gap 58 of the female contact 58. The sloped surface 32 of the pin contact 12 then enters the gap 58. As the pin contact 12 is advanced, the initial contact portion 20 of the pin contact 12 contacts the upper contact portion 60 and lower contact portion 62 of the female contact at the gap 58, resulting in the scraping of plating between the initial contact portion 20 and both the upper contact portion 60 and lower contact portion 62, as well as upper beam 54 and lower beam 56 biasing away from each other. Due to the conical shape of the sloped surface 32, the upper central area 61 of the upper contact portion 60 and/or the lower central area 63 of the lower contact portion 62 will first contact the initial contact portion 20.

The leading point 37 of the dimple 36 will then encounter the upper contact portion 60 and lower contact portion 62. At this point, the dimple 36 provides a cavity into which accumulated scrapings are deposited. Also, the lateral edges 38 effectively move the points of contact between the pin contact 12 and female contact 14 away from the center line 31 and the upper and lower central areas 61, 63 of the upper and lower contact portions 60 and 63, respectively. This shift in the contacting points reduces any riding of the female contact 14 on any plating build up and helps guide plating build up into the dimple 36. Further, this movement allows any subsequent scrapings which for any reason are not deposited in the dimple 36 to be pushed off toward the sides 28 in order that they will not accumulate at the final points of contact between the pin contact 12 and female contact 14. Also, the lateral shift of contact points minimizes any scraping of the central areas 61, 63 of the upper contact portion 60 and lower contact portion 62. As these central areas 61, 63 are the portions of the female contact 14 that will be contacting the pin contact 12 when the pin contact 12 and female contact 14 are in their final mated position, reducing scraping at the central areas 61, 63 helps maintain the proper amount of plating in place and improves electrical performance.

Further urging of the pin contact 12 into the female contact 14 results in the transition area 23 contacting the upper contact portion 60 and lower contact portion 62. After this point, the upper contact portion 60 and lower contact portion ride substantially horizontally on the main body 21 of the pin contact 12. Because the back edge 40 of the dimple 36 extends substantially to or beyond the transition area 23, the dimple 36 addresses the scraping accumulation very effectively.

The pin contact 12 is then advanced into the female contact 14 until the upper contact portion 60 and lower contact portion 62 contact the mating contact portions 22 of the main body 21 of the pin contact 12. This position, illustrated in FIG. 5, is the completely mated position.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical pin contact, comprising:

an initial contact portion having a lead end configured to be inserted into a female contact, said initial contact portion being joined to a main body, said initial contact portion having an external surface with a tapered contour extending between said lead end and said main body, said external surface including at least one recessed cavity formed therein to define a void in said tapered contour for receiving material accumulated during a mating operation.

2. The electrical pin contact of claim 1, further comprising a transition area joining said initial contact portion and said main body, said main body including a mating contact portion having a cross-section with a first area, said initial contact portion including a front edge having a cross-section with a second area that is smaller than said first area.

3. The electrical pin contact of claim 1 wherein said initial contact portion includes a tapered rectangular cross-section having first and second recessed cavities in top and bottom surfaces of said initial contact portion.

4. The electrical pin contact of claim 1 wherein said initial contact portion includes a non-circular cross-section with a top and a bottom joined by sides, said initial contact portion including a plurality of said recessed cavities.

5. The electrical pin contact of claim 1 wherein said electrical contact pin includes a transition area joining said initial contact portion and said main body, said main body including a mating contact portion having a substantially rectangular cross section, said initial contact portion including a front edge having a smaller cross section than said mating contact portion and a generally conic sloped surface leading from said front edge to said transition area.

6. An electrical contact system, comprising:

a contact pin including a tapered contact portion joined to a main body, said tapered contact portion including an evenly contoured external surface and an indentation recessed into said external surface; and a female contact matable with said contact pin, said female contact including at least one contact portion configured to contact said main body of said contact pin when said contact pin and said female contact are in a fully mated position, said female contact frictionally sliding over said external surface of said contact pin proximate said indentation.

7. The electrical contact system of claim 6 wherein said female contact slidably engages said contact pin on opposite sides of said indentation when said contact pin is inserted into said female contact.

8. The electrical contact system of claim 8 wherein said contact pin includes a transition area joining said tapered contact portion and said main body, said indentation extending substantially from a lead end of said tapered contact portion to said transition area.

9. The electrical contact system of claim 6 wherein said contact pin includes top and bottom surfaces joined by sides, wherein each of said top and bottom surfaces includes at least one indentation, said female contact including resiliently deflectable top and bottom beams engaging said top and bottom surfaces of said contact pin, respectively.

10. The electrical contact system of claim 6 wherein said main body includes a mating contact portion having a rectangular cross section, said tapered contact portion including a front edge having a rectangular cross section that is smaller than said rectangular cross section of said mating contact portion.

11. The electrical contact system of claim 6 wherein said tapered contact portion includes a front edge and a generally conic sloped surface leading from said front edge to said main body.

12. An electrical contact system, comprising:

a contact pin including an initial contact portion joined to a main body, said initial contact portion including an external surface and an indentation recessed into said external surface, said main body including a mating contact portion, said contact pin including a transition area joining said initial contact portion and said mating contact portion, said mating contact portion having a substantially rectangular cross section, said initial contact portion including a front edge having a cross section that is smaller than said rectangular cross section of said mating contact portion; said initial contact portion including a sloped surface leading from said front edge to said transition area; and a female contact matable with said contact pin, said female contact including at least one contact portion configured to contact said main body of said contact pin when said contact pin and said female contact are in a fully mated position, said female contact frictionally sliding over said external surface of said contact pin proximate said indentation, said female contact including a resiliently deflectable beam configured to contact said contact pin, said resiliently deflectable beam contacting said initial contact portion and sliding over said indentation as said contact pin is inserted into said female contact.

13. The electrical contact system of claim 12 wherein said female contact slidably engages said contact pin on opposite sides of said indentation when said contact pin is inserted into said female contact.

14. The electrical contact system of claim 12 wherein said female contact includes a pair of opposed resilient beams receiving said male contact pin.

15. The electrical contact system of claim 12 wherein said indentation extends substantially from a lead end of said tapered contact portion to said transition area.

16. The electrical contact system of claim 12 wherein said contact pin includes top and bottom surfaces joined by sides, wherein each of said top and bottom surfaces includes at least one indentation, said female contact including resiliently deflectable top and bottom beams engaging said top and bottom surfaces of said contact pin, respectively.

17. The electrical contact system of claim 12 wherein said sloped surface is generally cone shaped.

* * * * *